US008528204B2

(12) United States Patent
Sakamoto

(10) Patent No.: US 8,528,204 B2
(45) Date of Patent: Sep. 10, 2013

(54) METHOD FOR PRODUCING CONNECTOR TERMINAL AND METHOD FOR ASSEMBLING MULTI-STAGE CONNECTOR

(75) Inventor: Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/565,191

(22) Filed: Aug. 2, 2012

(65) Prior Publication Data

US 2012/0291278 A1 Nov. 22, 2012

Related U.S. Application Data

(63) Continuation of application No. PCT/JP2011/052297, filed on Feb. 3, 2011.

(30) Foreign Application Priority Data

Feb. 3, 2010 (JP) ..... 2010-022438

(51) Int. Cl.
*H01R 43/20* (2006.01)

(52) U.S. Cl.
USPC ..... 29/876; 29/874; 29/884; 439/79

(58) Field of Classification Search
USPC ..... 29/874, 876, 882, 884; 439/79, 439/607.06, 629, 884, 885
See application file for complete search history.

(56) References Cited

U.S. PATENT DOCUMENTS

| | | | | |
|---|---|---|---|---|
| 4,292,736 | A * | 10/1981 | Hughes et al. | 29/884 |
| 4,568,136 | A * | 2/1986 | Reuss | 439/629 |
| 6,132,255 | A * | 10/2000 | Verhoeven | 439/607.06 |
| 6,406,338 | B1 | 6/2002 | Endo et al. | |
| 6,638,121 | B1 * | 10/2003 | Walker et al. | 439/885 |
| 2002/0002007 | A1 | 1/2002 | Endo et al. | |

FOREIGN PATENT DOCUMENTS

| | | | |
|---|---|---|---|
| JP | 315183 | A | 1/1991 |
| JP | 11162611 | A | 6/1999 |
| JP | 200030834 | A | 1/2000 |

OTHER PUBLICATIONS

International Search Report dated Mar. 1, 2011 from the International Searching Authority in counterpart application No. PCT/JP2011/052297.

Written Opinion dated Mar. 1, 2011 from the International Searching Authority in counterpart application No. PCT/JP2011/052297.

* cited by examiner

*Primary Examiner* — Donghai D. Nguyen
(74) *Attorney, Agent, or Firm* — Sughrue Mion, PLLC

(57) ABSTRACT

2N (where N=1, 2, 3, . . . ) rod-shaped terminals, having overall lengths that vary in sequence, are formed out of a single metal plate by press punching. In the metal plate, rod bodies bridging between a first carrier and a second carrier are arranged so that the lengthwise direction of the rod bodies is perpendicular to the lengthwise direction of the metal plate, the 2N terminals are divided such that the first N in descending order of length are in a first group, and the remaining N are in a second group, the n-th shortest terminal and the n-th longest terminal are selected from the terminals of the first and second groups and combined one by one, and each combined pair of terminals is disposed in series over one rod body.

4 Claims, 12 Drawing Sheets

METHOD FOR PRODUCING CONNECTOR TERMINAL AND METHOD FOR ASSEMBLING MULTI-STAGE CONNECTOR

CROSS REFERENCE TO RELATED APPLICATION

This application is a continuation of PCT application No. PCT/JP2011/052297, which was filed on Feb. 2, 2011 based on Japanese Patent Application (No. 2010-022438) filed on Feb. 3, 2010, the contents of which are incorporated herein by reference. Also, all the references cited herein are incorporated as a whole.

BACKGROUND

1. Technical Field

The present invention relates to a method for producing a connector terminal for a multi-stage connector and a method for assembling a multi-stage connector in which terminals obtained by the method for producing the connector terminal are assembled to a connector housing.

2. Background Art

A multi-stage connector having a plurality of, upper and lower, stages in terminal arrangements as shown in FIG. 11 is, for example, known as a connector which is directly mounted on a printed circuit board (see e.g., JP-A-11-162611). In such a multi-stage connector, terminal elements 521 and 522 are inserted into and fixed to press-fit holes 503 formed on a rear wall 502 of a connector housing 501. Lengths of rear leg sections extending from a rear part of the connector housing 501 are different from each other between the terminal elements 521 at the upper stage and the terminals 522 at the lower stage, as shown in FIG. 13A so that total lengths are different from each other.

As a producing method of collectively molding the terminal elements 521 and 522 having different lengths by a press punching process with a good process yield, a method is proposed in which two kinds of terminal elements 521 and 522 are alternately arranged in opposite orientations as shown in FIG. 13B so as to be molded, and after the molding, the cutting points d connecting to respective carriers 511 and 522 are cut off, thereby obtaining separated terminal elements 521 and 522.

However, in a case where the number of kinds of lengths of terminal elements is increased, the yield of the material is degraded so that the cost is increased.

Therefore, a method of press processing six kinds of terminal elements 621 to 626 (terminal elements for respective stages) having different lengths by using different dies is sometimes taken as shown in FIG. 12.

SUMMARY

However, in the above case, the cost of dies or the processing cost is unnecessarily increased so that the producing cost is increased. In addition, in a case where there is only a material of a band plate having a predetermined width, the yield cost of the material is deteriorated, similarly.

The invention is made in view of the above circumstances, and the purpose of the invention is to provide a method for producing a connector terminal in which all of the terminals having the lengths of stages which are different from each other are collectively formed by a single die while minimizing material loss as much as possible, and to provide a method for assembling a multi-stage connector by using the connector terminals obtained by the above method.

In order to solve the above problems, there is provided a method for producing a connector terminal according to a first aspect of the invention by forming a plurality of terminal elements from a single band-shaped metal plate by press punching wherein the terminal elements are to be attached to a single connector housing and are 2N (where, N=1, 2, 3, . . . ) rod-shaped terminal elements having overall lengths varied in sequence because lengths of rear leg sections extending from a rear part of the connector housing are different from each other, are formed by press punching out of a single band-shaped metal plate. In the producing method, a plurality of rod bodies bridged between a first carrier and a second carrier which are disposed along both side edges of the metal plate are arranged on the metal plate in such a manner that a lengthwise direction of the rod bodies is perpendicular to a longitudinal direction of the metal plate. A pair of combined terminal elements in series on one rod body is arranged in such matter that the 2N terminal elements are classified such that the first N terminal elements in descending order of length are in a first group, and the remaining N terminal elements are in a second group. The n-th terminal element (where, n=1, 2, 3, . . . ; and $n \leqq N$) from the shortest one and the n-th terminal element from the longest one are selected from among the terminal elements of the first and second groups and are combined one by one. Under the above condition, each of the terminal elements is formed from the metal plate by press punching.

A method for producing a connector terminal according to a second aspect of the invention, is based on the first aspect of the invention. In a case that the n-th terminal element from the shortest one and the n-th terminal element from the longest one are selected from among the terminal elements of the first and second groups and are combined one by one and then the combined two terminal elements are arranged in series on the single rod body, the combined two terminal elements are arranged on the rod body at the n-th row arranged on the metal plate, and a set of the terminal elements formed by the rod bodies in the first to the N-th rows are made to be one unit, and two or more units of terminals are formed from the one metal plate.

A method for producing a connector terminal according to a third aspect of the invention, is based on the second aspect of the invention. The producing method includes a process of obtaining a plate shaped molded article including the carriers and the rod bodies, a cutting-off process of cutting off the molded article at a connection position between the two terminal elements on each rod body under a condition that the carriers are connected thereto so as to cut off a first terminal row having the terminal elements in the first group and a second terminal row having the terminal elements in the second group, and a bending process in which a bending force in a direction perpendicular to the plate face is applied to the plate shaped molded article cut off in the cutting-off process so as to form a L-shaped bent section which is adapted to form a rear leg section on each of the terminal elements constituting the first terminal row and the second terminal row, thereby forming, on each terminal element, a horizontal straight section having an electric contact section to be electrically contacted with a counter terminal at a front end side and a vertical straight section formed by being bent vertically downward from a rear end of the horizontal straight section. In the bending process, by performing the bending process while adjusting a position of the bent section of each terminal element in the vertical direction, heights of the rear leg sections of the terminal elements having different lengths from the lower end parts of the vertical straight sections to the bent sections are differentiated in the order of the lengths of the terminal elements under a condition that the front end positions of the electric contact sections of all of the terminal elements in the respective first and second terminal rows are aligned.

A method for assembling a multi-stage connector having a terminal arrangement of 2N (where N=1, 2, 3, . . . ) stages in the vertical direction according to a fourth aspect of the invention, is based on the producing method according to the third aspect of the invention. The method for assembling a multi-stage connector includes: a process of obtaining the first terminal row and the second terminal row having the carriers; a second terminal row assembling process in which horizontal straight sections of the terminal elements of the second terminal row are inserted into respective press-fit holes arranged from the lower end to the N-th stages at a rear wall of a connector housing of the multi-stage connector, and thereby an electric contact section of each terminal element of the second terminal row is accommodated in a hood of the connector housing; a second carrier cutting-off process of performing, after the above process, cutting-off of the second carrier to which the rear leg sections of the terminal elements are connected; a first terminal row assembling process in which after performing the second carrier cutting-off process, horizontal straight sections of the terminal elements of the first terminal row are inserted into respective press-fit holes arranged from the top to the N-th stages at the rear wall of the connector housing of the multi-stage connector, and thereby an electric contact section of each terminal element of the first terminal row is accommodated in the hood of the connector housing; and a first carrier cutting-off process of performing, after the above process, cutting-off of the first carrier to which the rear leg sections of the terminal elements are connected.

In accordance with the first aspect of the invention, since two kinds of, i.e., long and short terminal elements are combined and arranged on each single rod body, the lengths of the rod bodies arranged on the metal plate can be equalized so that the connector terminals can be collectively and efficiently produced by press punching while minimizing material loss. Therefore, it is possible to minimize the cost of a die or processing as much as possible, and thereby to reduce the producing cost of the terminals.

In accordance with the second aspect of the invention, since many kinds of terminal elements are collectively formed while aligning the arrangement order of the terminal elements as the order in lengths of the terminal elements, the terminal elements can be readily assembled to the connector housing under a condition that the terminal rows are connected to the carrier.

In accordance with the third aspect of the invention, since the first terminal row in which the long terminal elements are collected and the second terminal row in which the short terminal elements are collected, are respectively subjected to the bending process, it is possible to reduce the number of times of bending processes and kinds of dies for processing, thereby reducing the processing cost.

In accordance with the fourth aspect of the invention, the terminal elements in the multi-stages at the lower side and the terminal elements in the multi-stages at the upper side can be collectively inserted into and assembled to the press-fit holes of the connector housing with respect to the lower and upper side stages while the terminal elements are connected to the carriers. Therefore, the number of times of the press fitting can be reduced, thereby reducing troubles in the assembling.

BRIEF DESCRIPTION OF THE DRAWINGS

FIG. 5A is a perspective view showing a state that the terminal elements of the second terminal row shown in FIG. 4 are subjected to the bending process, and FIG. 5B is a perspective view showing a state that the terminal elements of the first terminal row shown in FIG. 4 are subjected to the bending process.

FIG. 6A and FIG. 6B are elevational side views respectively showing the terminal rows shown in FIG. 5A and FIG. 5B.

FIG. 13A is a plan view showing the structures of the terminal elements to be used in the related art multi-stage connector shown in FIG. 11, and FIG. 13B is a plan view showing a molded article having terminal elements which are collectively formed by press molding.

DETAILED DESCRIPTION OF THE EXEMPLARY EMBODIMENTS

An embodiment of the invention is described below with reference to accompanying drawings.

Figure 1:
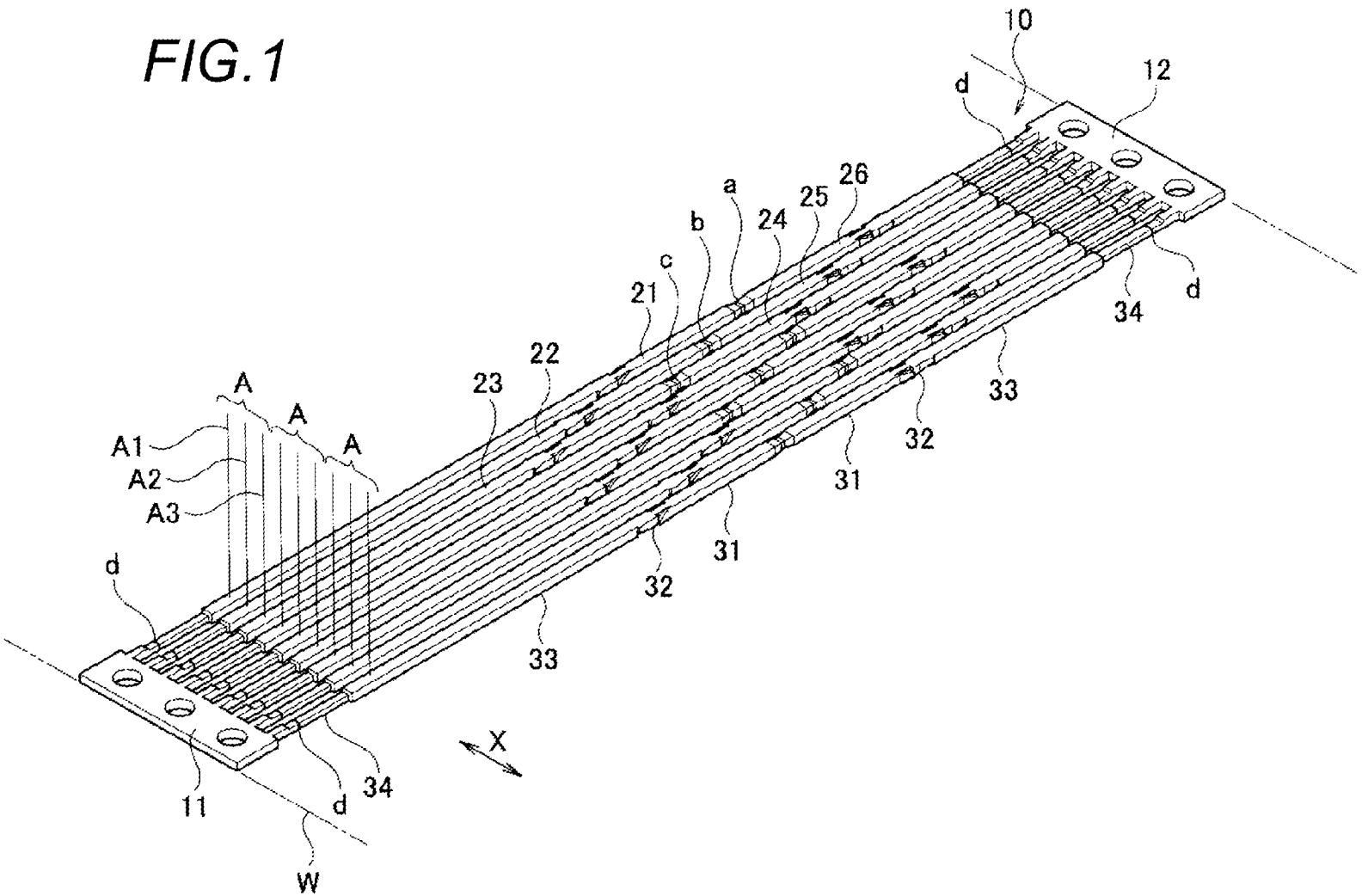
FIG. 1 is a perspective view showing a partial structure of a molded article obtained by a press processing according to an embodiment of the invention.
Figure 2:
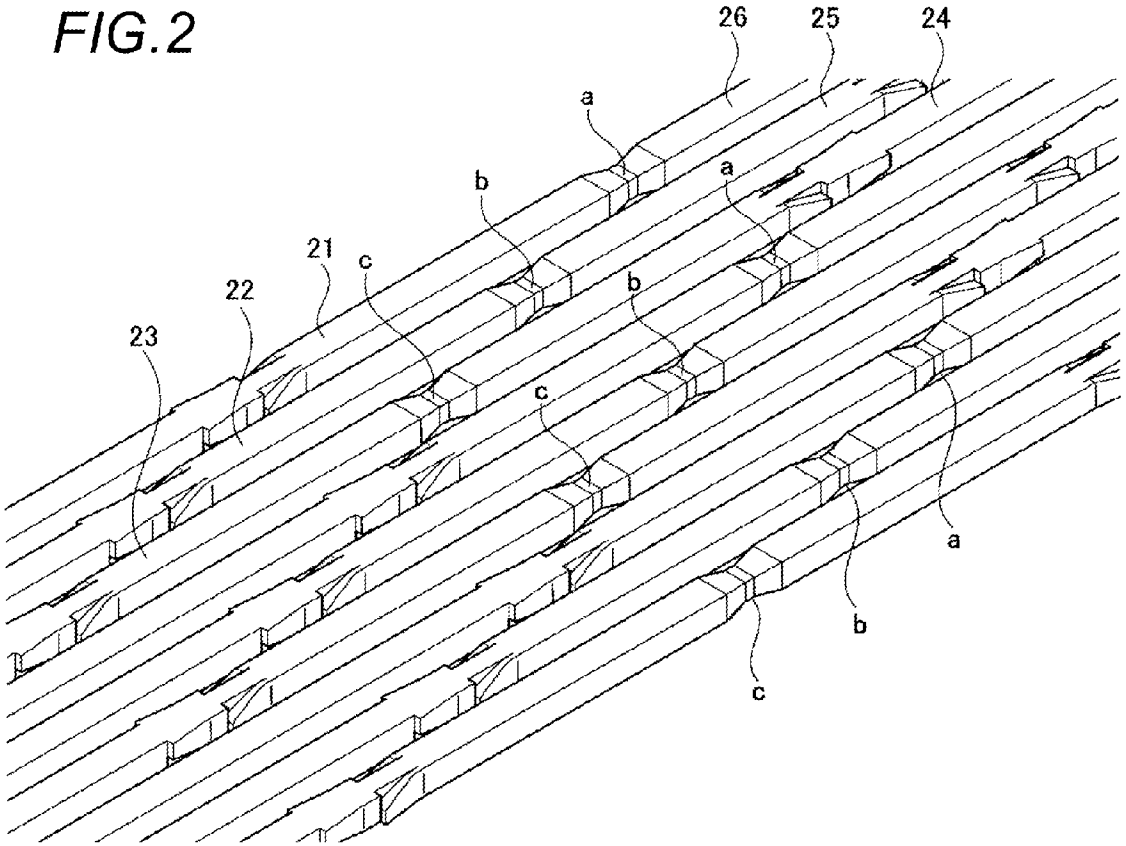
FIG. 2 is an enlarged perspective view showing a main part of the molded article shown in FIG. 1.
Figure 3:
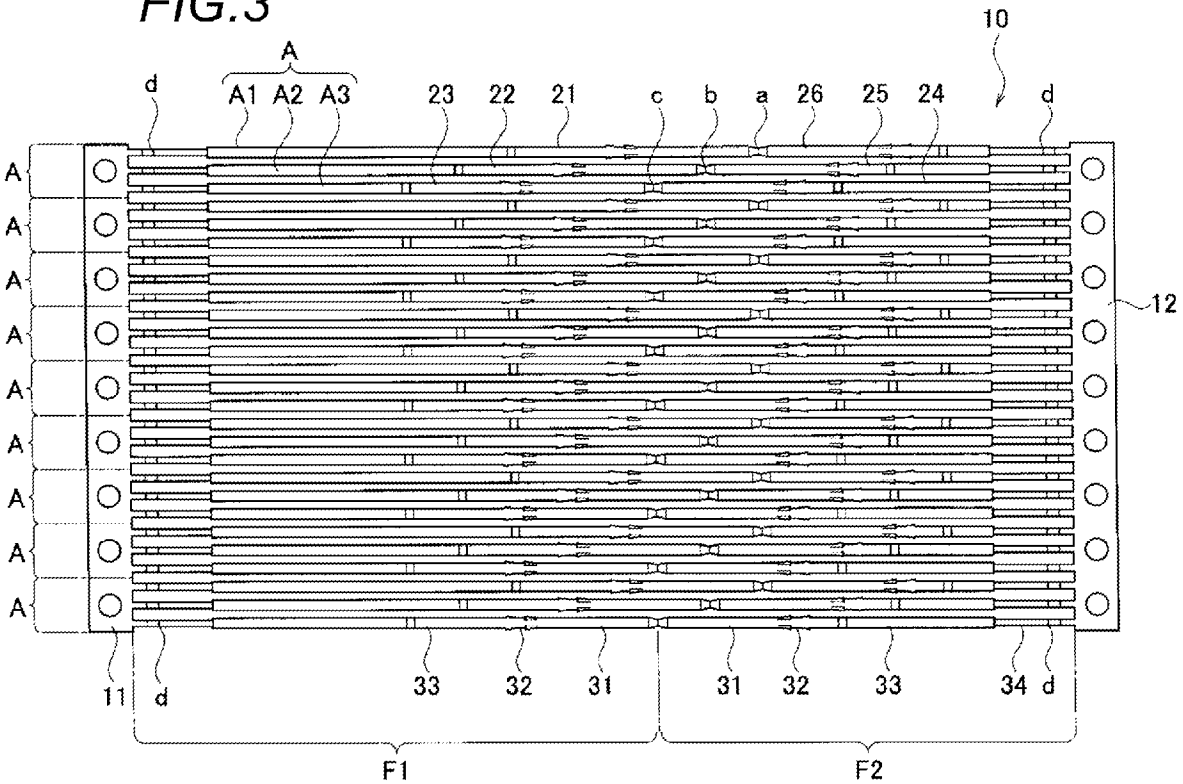
FIG. 3 is a plan view showing the molded article.

FIG. 1 is a perspective view showing a partial structure of a molded article obtained by a press processing by a method according to the embodiment. FIG. 2 is an enlarged perspective view showing a main part of the molded article. FIG. 3 is a plan view showing the molded article.

A producing method of the embodiment is configured such that six rod-shaped terminal elements 21 to 26 which are to be attached to a single connector housing 100 and respectively have rear leg sections 33 extending from a rear side of the connector housing 100 and having different lengths, and thereby have total lengths varied in sequence, are formed from a single band-shaped metal plate W by press punching. In the producing method of the embodiment, a first carrier 11 and a second carrier 12 are first arranged on the metal plate W along both side edges of the metal plate W. In addition, a plurality of rod bodies A1 to A3 bridged between the first carrier 11 and the second carrier 12 are arranged on the metal plate W in such a manner that the lengthwise direction of the rod bodies A1 to A3 is perpendicular to the longitudinal direction X of the metal plate W.

On the other hand, the six terminal elements 21 to 26 having different total lengths to be used for a multi-stage connector having six stages are classified such that three terminal elements in descending order of length from the longest one are in a first group and the remaining three terminal elements are in a second group. The n-th terminal element 24, 25 or 26 from the shortest one and the n-th terminal element 21, 22 or 23 from the longest one are selected from among the terminal elements 21 to 26 in the respective groups (where n=1, 2, 3, . . . ; and n≦N) and are combined one by one. The combined two terminal elements 21 and 26, 22 and 25, and 23 and 24 are arranged in series on the rod bodies A1 to A3 respectively.

Each of the terminal elements 21 to 26 has, as a common structure, an electric contact section 31 which is disposed at a front end and is to be contacted with a counter terminal, a press-fit engagement section 32 which is disposed at the rear side thereof and is to be engaged with a press-fit hole of the connector housing 100, and a rear leg section 33 which protrudes to the outside from a rear side of the connector housing 100 when it is set in the connector housing 100. Each of the terminal elements 21 to 26 has a substrate connection section 34 disposed at a base end (also referred to as a rear end) of the rear leg section 33. The set of the terminal element 21, 22 or 23 in the first group and the terminal element 24, 25 or 26 in the second group are arranged on each of the rod bodies A1 to A3 so as to be in orientations opposite to each other. The front ends of the electric contact sections 31 are coupled with each other at each of connection positions a to c to be cut off, and the rear ends of the substrate connection sections 34 are respectively coupled to the first carrier 11 and the second carrier 12 with connection positions d to be cut off therebetween.

In the above case, each two of the terminal elements 21 to 26 are arranged on the rod body at the n-th row in the rod bodies A1 to A3 arranged on the metal plate W. While a set of terminal elements 21 to 26 formed by the rod bodies A1 to A3 from the first row to the third row are made as one unit, two or more units of terminal elements 21 to 26 are formed from the single metal plate W.

To be specific, the first longest terminal element 21 and the first shortest terminal element 26 are combined and are arranged in series on the one rod body A1 disposed at the first row. In addition, the second longest terminal element 22 and the second shortest terminal element 25 are combined and are arranged in series on the one rod body A2 disposed at the second row. Further, the third longest terminal element 23 and the third shortest terminal element 24 are combined and are arranged in series on the one rod body A3 disposed at the second row. By making the set of the terminal elements 21 to 26 formed by the rod bodies A1 to A3 from the first row to the third row as one unit A, two or more units of terminal elements 21 to 26 are formed from the single metal plate W.

In accordance with the producing method, since the two kinds of, i.e., long and short terminal elements 21 and 26, 22 and 25, or 23 and 24 are combined and arranged on each one of the rod bodies, the lengths of the rod bodies A1 to A3 arranged on the metal plate W can be equalized. Consequently, it is possible to collectively and efficiently produce the connector terminals 21 to 26 while minimizing the material loss as much as possible. Therefore, it is possible to suppress the cost of the die or processing to its minimum, and thereby to reduce the production cost of the terminal elements. In addition, since various kinds of terminal elements 21 to 26 are collectively molded while aligning the arrangement order of the terminal elements 21 to 26 as the order in lengths of the terminal elements 21 to 26, the terminal elements 21 to 26 can be readily assembled to the connector housing 100 of the multi-stage connector under a condition that terminal rows F1 and F2 are connected to the carriers 11 and 12.

Next, a sequence of forming the multi-stage connector from the molded article 10 molded as shown in FIG. 3 by assembling the terminal elements 21 to 26 to the connector housing 100, is described below.

Figure 4:
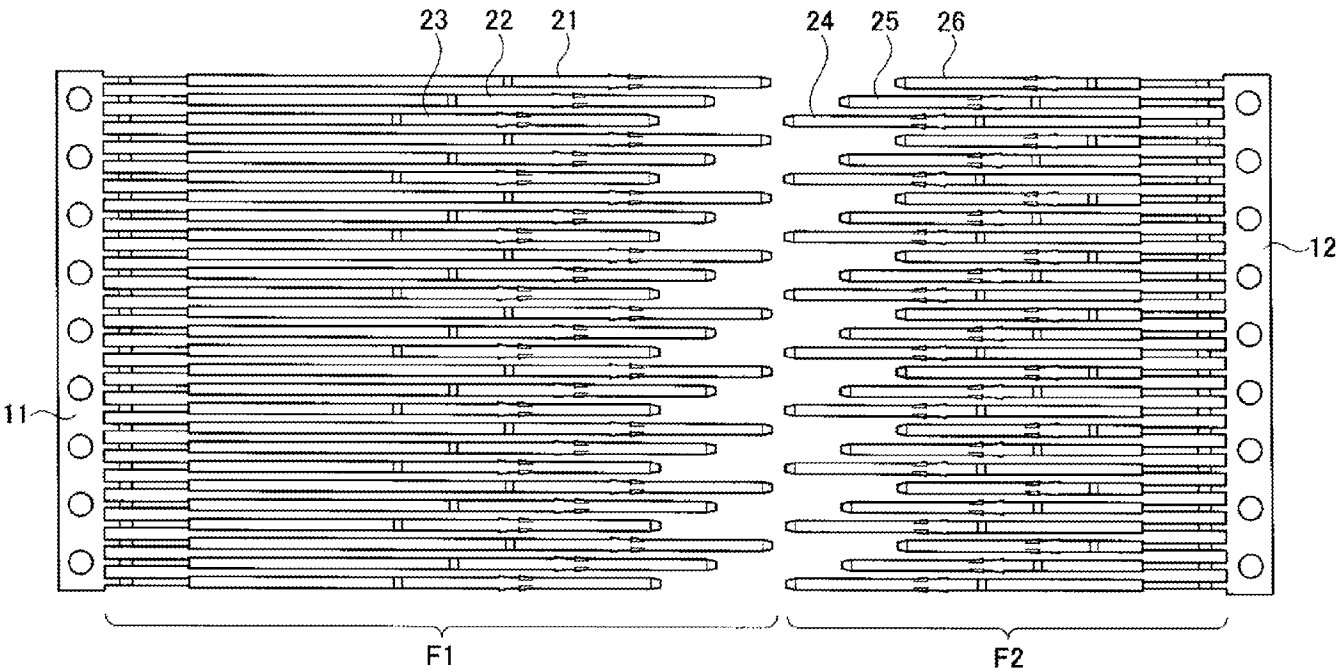
FIG. 4 is a plan view showing a state that the molded article is cut and separated into a first terminal row and a second terminal row.
Figure 5A:
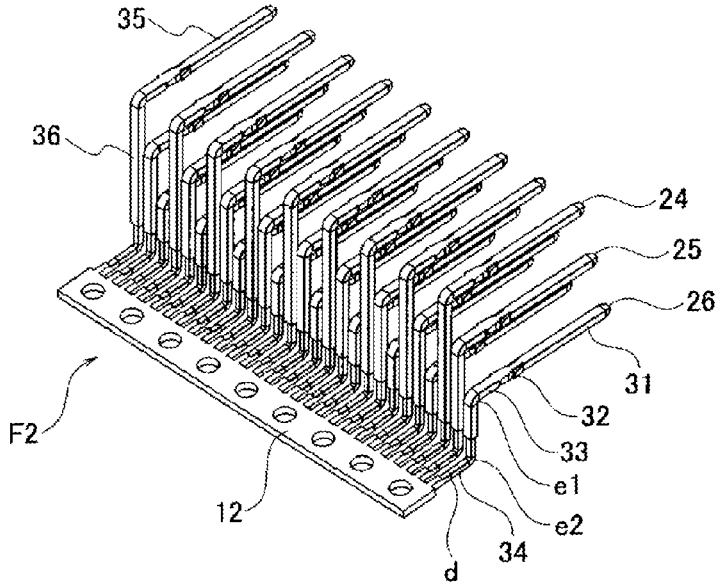
FIGS. 5A and 5B are schematic views showing a state that rear leg sections of terminal elements of the first terminal row and rear leg sections of terminal elements of the second terminal row are subjected to a bending process.
Figure 5B:
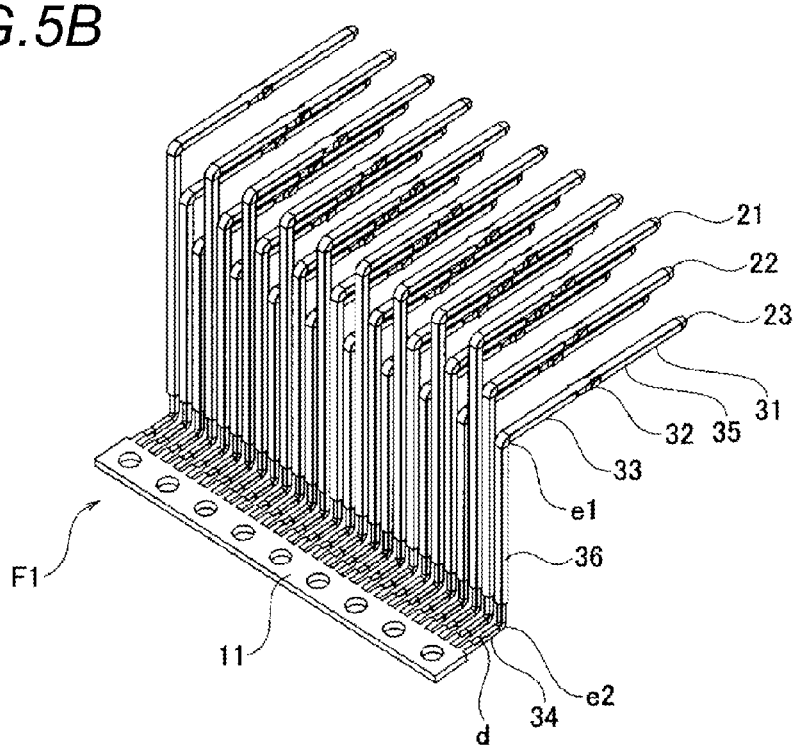
Figure 6A:
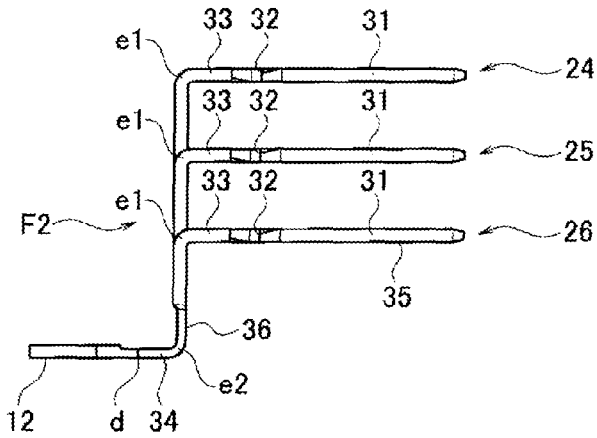
FIGS. 6A and 6B are elevational side views showing the terminal elements of the first terminal row and the terminal elements of the second terminal row.
Figure 6B:
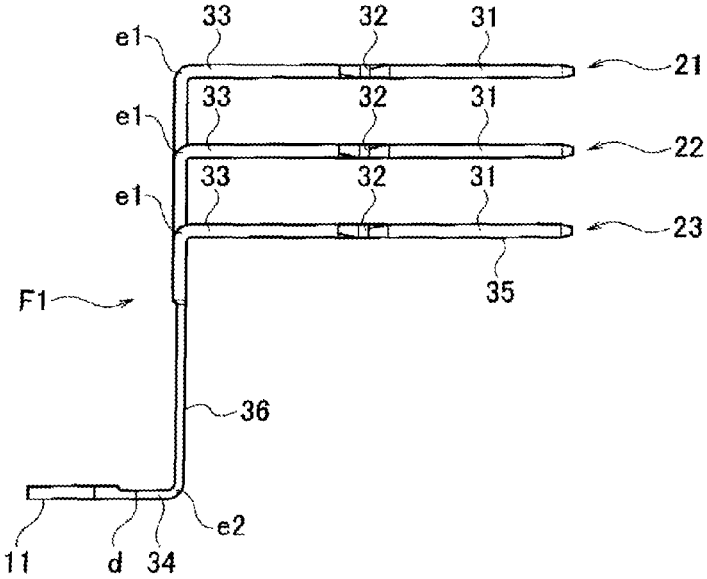

First, the plate shaped molded article 10 including the carriers 11 and 12 and the rod bodies A1 to A3 as shown in FIG. 3. is formed. Next, the molded article 10 is cut at the connection positions a to c (see FIG. 3) of each two of the terminal elements 21 to 26 arranged on the respective rod bodies A1 to A3 as shown in FIG. 4 under a condition that the carriers 11 and 12 are connected to the molded article 10, and thereby the molded article 10 is cut and separated into the first terminal row F1 constituted by the set of terminal elements 21 to 23 in the first group and the second terminal row F2 constituted by the set of terminal elements 24 to 26 in the second group.

Next, a bending force in a direction perpendicular to the plate face is applied to the cut off plate shaped molded article (the first terminal row F1 and the second terminal row F2), and thereby L-shaped first bent sections e1 constituting the rear leg sections 33 are formed on the respective terminal elements 21 to 26 constituting the first terminal row F1 and the second terminal row F2 as shown in FIGS. 5A and 5B and FIGS. 6A and 6B. With this, a horizontal straight section 35 having an electric contact section 31 to be electrically contacted with a counter terminal disposed at a front end side and a vertical straight section 36 which is bent vertically downward from a rear end of the horizontal straight section 35 can be formed on each of the terminal elements 21 to 26. By adding a second bent section e2 at the same time of the bending process, a substrate connection section 34 in parallel to the horizontal straight section 35 is formed.

Meanwhile, in the bending process, by performing the bending process while adjusting a position of the first bent section e1 of each of the terminal elements 21 to 26 in the vertical direction, heights of the rear leg sections 33 of the terminal elements 21 to 26, having different lengths, from the lower end parts (second portions e2) of the vertical straight sections 36 to the first bent sections e1 are differentiated in the order of the lengths of the terminal elements 21 to 26 under a condition that the front end positions of the electric contact sections 31 of all the terminal elements 21 to 26 in the respective first and second terminal rows F1 and F2 are aligned.

Thus, since the first terminal row F1 having the set of long terminal elements 21 to 23 and the second terminal row F2 having the set of short terminal elements 24 to 26 are respectively subjected to the bending process so as to cause the terminal elements 21 to 26 to be collectively bent with respect to the first and second terminal rows F1 and F2, it is possible to reduce the number of times of bending processes and kinds of dies for processing, and thereby to reduce the processing cost.

Figure 7:
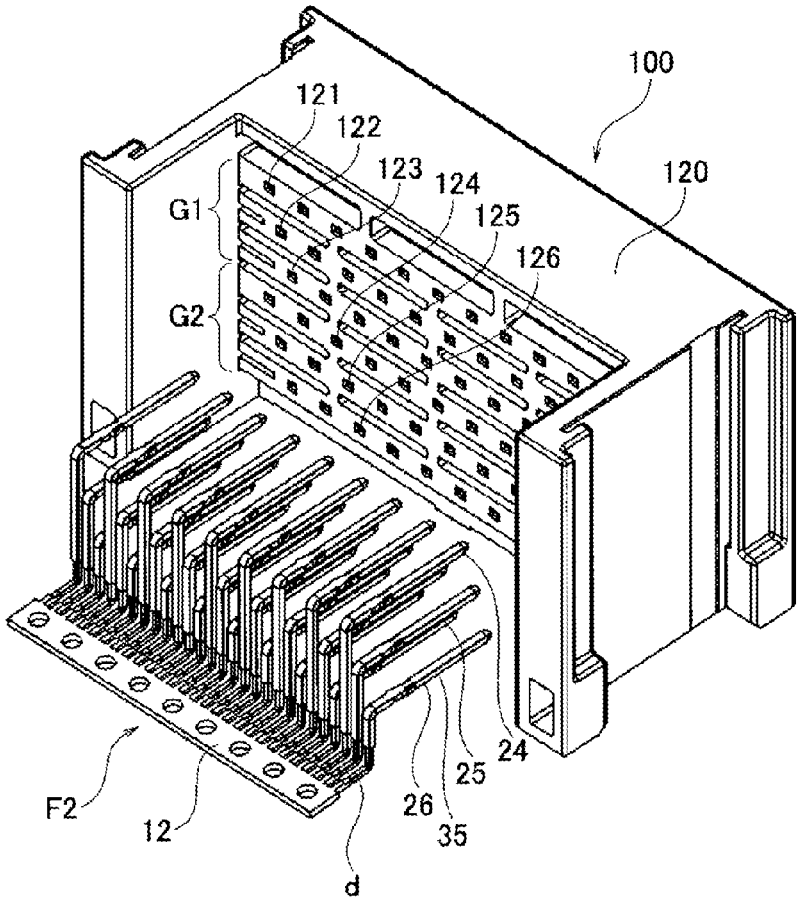
FIG. 7 is a perspective view showing a state that the terminal elements of the second terminal row shown in FIG. 5A are going to be press-fitted into a connector housing.

Next, as shown in FIG. 7, the horizontal straight sections 35 of the terminal elements 24 to 26 of the second terminal row F2 with the carrier 12 produced as in the above are press-fitted into press-fit holes 124 to 126 arranged from the lower end to the third stages at a rear wall 120 of the connector housing 100 of the multi-stage connector having six stages, and thereby the electric contact sections 31 of the terminal elements 24 to 26 of the second terminal row F2 are accommodated in a hood of the connector housing 100 (a second terminal row assembling process). After that, the second carrier 12 connected to the rear leg sections 33 of the terminal elements 24 to 26 is cut off at the connection positions d to be separated therefrom (a second carrier cutting-off process).

Figure 8:
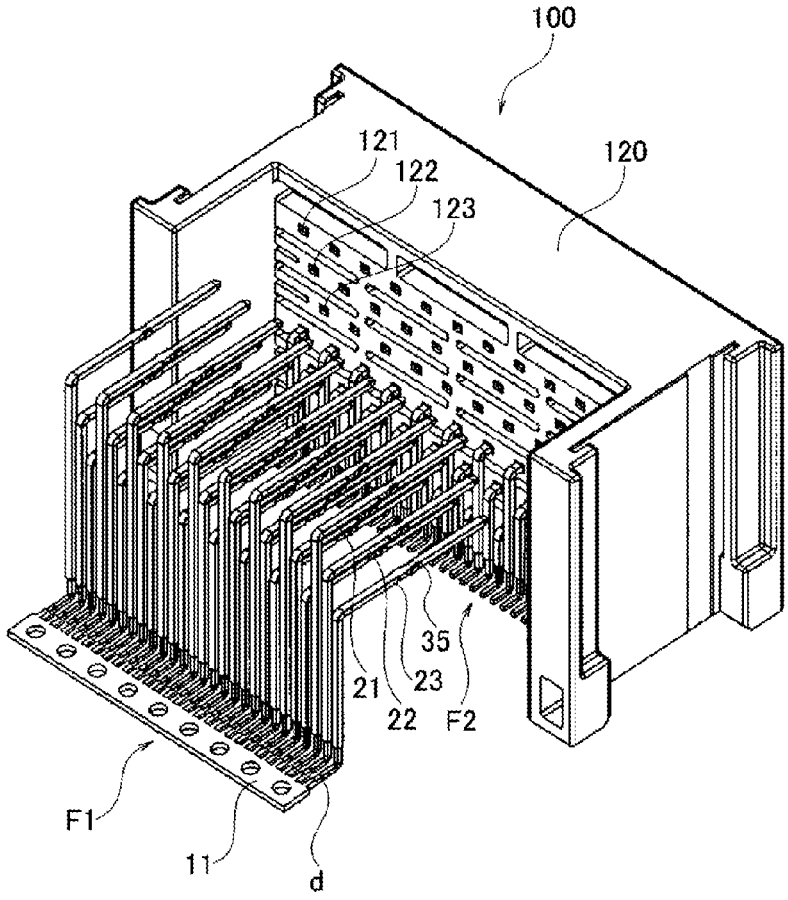
FIG. 8 is a perspective view showing a state that after the terminal elements of the second terminal row are press-fitted thereinto, a second carrier is cut off, and then the terminal elements of the first terminal row shown in FIG. 5B are going to be press-fitted into the connector housing.
Figure 9:
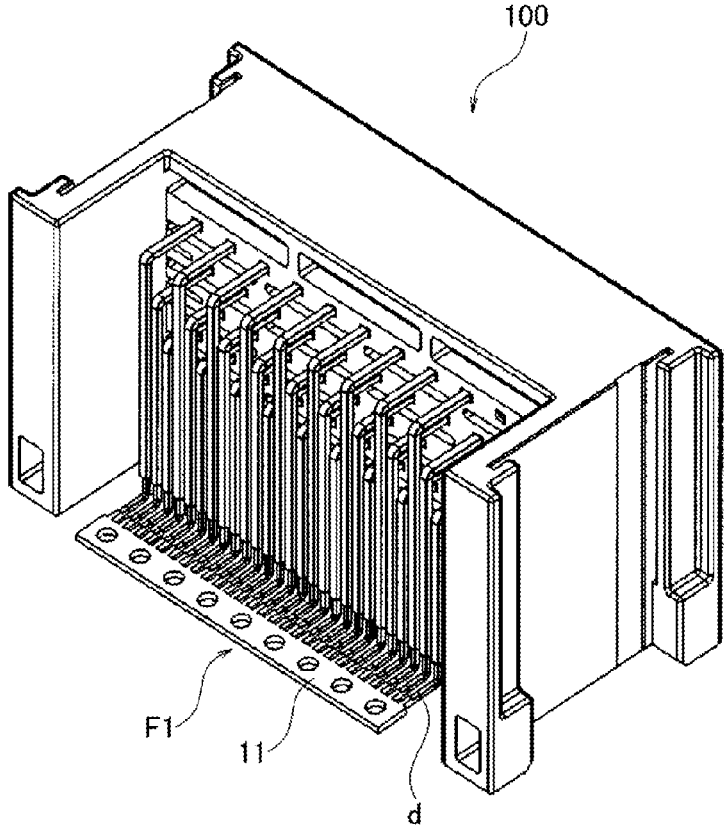
FIG. 9 is a perspective view showing a state that the press-fitting of the terminal elements of the first terminal row into the connector housing is completed.
Figure 10:
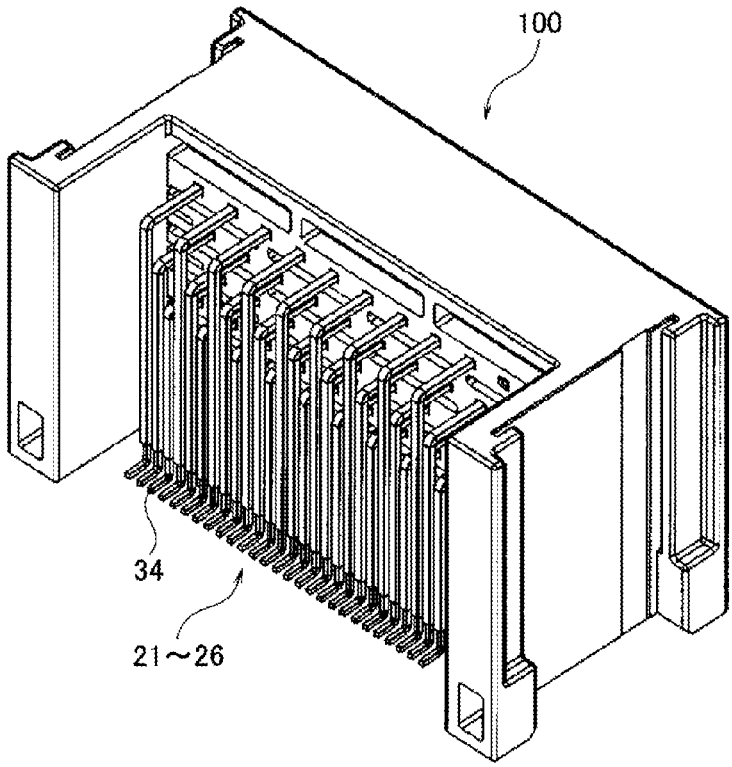
FIG. 10 is a perspective view showing a state that a first carrier is cut off after the press-fitting.
Figure 11:
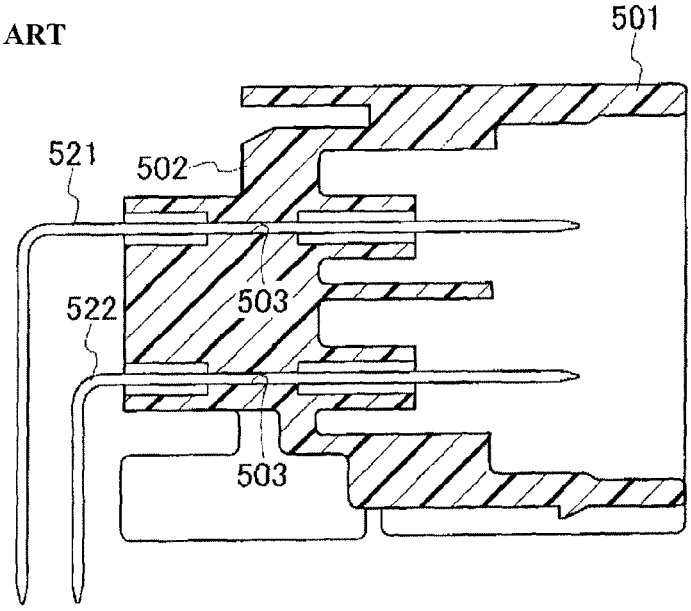
FIG. 11 PRIOR ART
FIG. 11 is a cross sectional view showing an example of a related art multi-stage connector.
Figure 12:
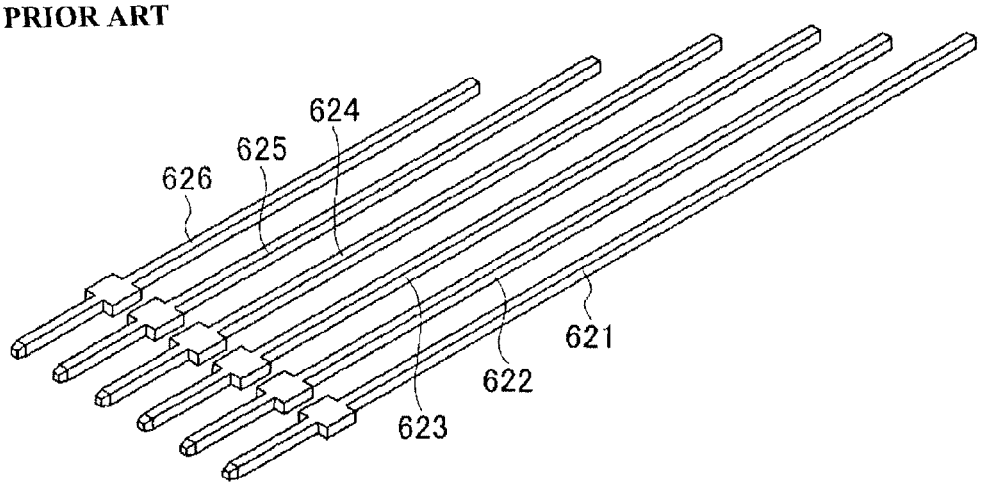
FIG. 12 PRIOR ART
FIG. 12 is a perspective view showing structures of the terminal elements to be used in a six-stage type multi-stage connector.
Figure 13A:
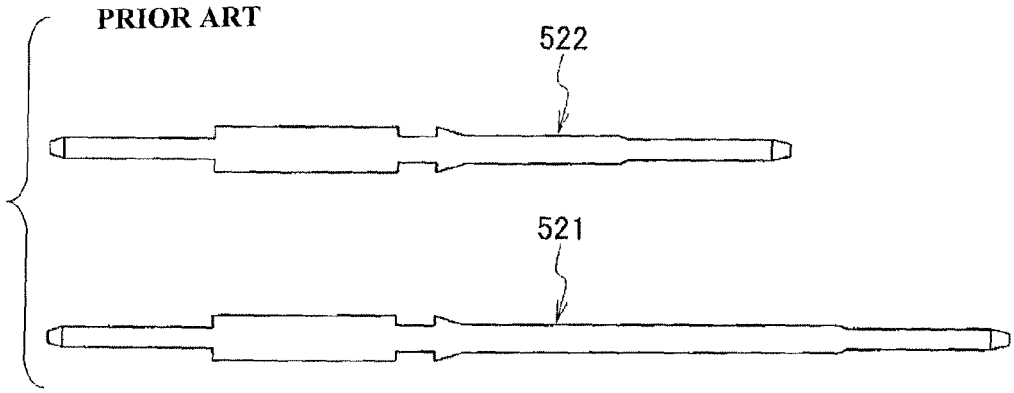
FIGS. 13A and 13B are schematic views showing structures of terminal elements to be used in the related art multi-stage connector shown in FIG. 11.
Figure 13B:
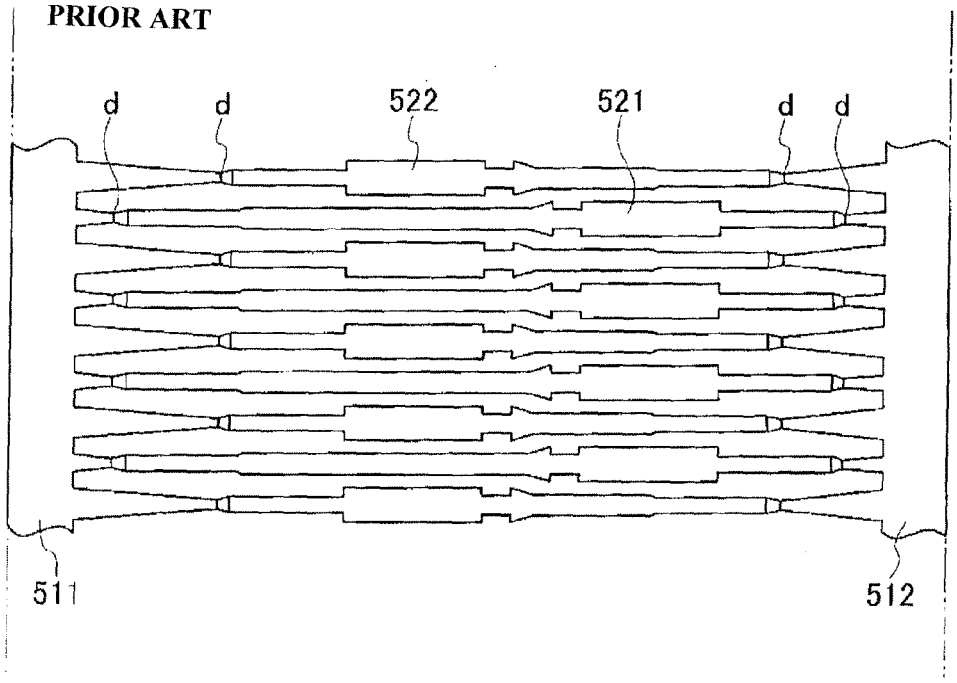

Next, as shown in FIGS. 8 and 9, the horizontal straight sections 35 of the terminal elements 21 to 23 of the first terminal row F1 are press-fitted into press-fit holes 121 to 123 arranged from the top to the third stages at the rear wall 120 of the connector housing 100, and thereby the electric contact sections 31 of the terminal elements 21 to 23 are accommodated in the hood of the connector housing 100 (a first terminal assembling process). After that, the first carrier 11 connected to the rear leg sections 33 of the terminal elements 21 to 23 is cut off at the connection positions d to be separated therefrom (a first carrier cutting-off process), thereby the multi-stage connector having six stages can be completed as shown in FIG. 10.

Thus, the terminal elements 24 to 26 in three stages at the lower side and the terminal elements 21 to 23 in three stages at the upper side can be collectively inserted into the press-fit holes 121 to 126 of the connector housing 100 so as to be assembled to the connector housing 100 while the carriers 11 and 12 are connected to the terminal elements 21 to 26. Therefore, the number of times of press-fitting can be reduced and trouble in the assembling can be suppressed.

While a case in which the six kinds of terminal elements 21 to 26 having different lengths to be used in the multi-stage connector having six stages are produced and assembled to the connector housing 100, is described in the above embodiment, the number of stages is not limited thereto.

For example, in a case where a multi-stage connector having terminal arrangement of arbitrary 2N (where, N=1, 2, 3, . . . ) in the vertical direction is formed, 2N terminal elements to be used therein is classified such that N terminals from the longest one are in a first group and the remaining N terminals are in a second group. The n-th terminal element (where, n=1, 2, 3, . . . , and n<=N) from the shortest one and the n-th terminal element from the longest one are selected from the terminal elements in the respective groups and are combined one by one. The combined two terminal elements are arranged in series on each of the rod bodies. At that time, the two terminal elements are arranged on the rod body at the n-th row arranged on the metal plate, and by making the set of the terminal elements formed by the rod bodies from the first to the third rows as one unit, two or more units of terminal elements are molded from the single metal plate.

In addition, the terminal elements formed as in the above are collectively subjected to the bending process, and thereby assembled to the connector housing of the multi-stage connector having 2N stages (where, N=1, 2, 3, . . . ). At that time, first, the horizontal straight sections of the terminal elements (shorter ones) of the second terminal row are inserted into the press-fit holes arranged from the lower end to the N-th stages of the connector housing, and then the second carrier is cut off. Next, the horizontal straight sections of the terminal elements (longer ones) of the first terminal row are inserted into the press-fit holes arranged from the top to the N-th stages of the connector housing, and then the first carrier is cut off. By the above processes, the multi-stage connector having arbitrary 2N stages can be achieved.

While the invention is described in detail by referring to a specific embodiment, it is understood by those of ordinary skill in the art that various modifications and changes can be made without departing from the sprit and scope of the invention.

What is claimed is:

1. A method for producing a connector terminal by forming a plurality of terminal elements from a single band-shaped metal plate by press punching, wherein the terminal elements are to be attached to a single connector housing and are 2N (where, N=1, 2, 3, . . . ) rod-shaped terminal elements having overall lengths varied in sequence due to lengths of rear leg sections extending from a rear part of the connector housing being different from each other, the method comprising the steps of:

forming a plurality of rod bodies and arranging the rod bodies such that the rod bodies are bridged between a first carrier and a second carrier which are disposed along both side edges of the metal plate on the metal plate such that a lengthwise direction of the rod bodies is perpendicular to a longitudinal direction of the metal plate;

arranging a pair of combined terminal elements in series on one rod body in such matter that the 2N terminal elements are arranged such that first N terminal elements in descending order of length are in a first group and a remaining N terminal elements are in a second group, a n-th terminal element (where, n=1, 2, 3, . . . ; and n≦N) from the shortest one and a n-th terminal element from the longest one are selected from among the terminal elements of the first and second groups and are combined one by one; and forming each of the terminal elements from the metal plate by press punching under the arranged condition.

2. The method for producing the connector terminal according to claim 1, wherein in a case that the n-th terminal element from the shortest one and the n-th terminal element from the longest one are selected from among the terminal elements of the first and second groups and are combined one by one and then the combined two terminal elements are arranged in series on the single rod body, the combined two terminal elements are arranged on the rod body at the n-th row arranged on the metal plate; and wherein a set of the terminal elements formed by the rod bodies in the first to the N-th rows are made to be one unit, and two or more units of terminals are formed from the one metal plate.

3. The method for producing a connector terminal according to claim 2, further comprising the steps of:

obtaining a plate shaped molded article including the carriers and the rod bodies, cutting off the molded article at a connection position between the two terminal elements on each rod body under a condition that the carriers are connected thereto so as to cut off a first terminal row having the terminal elements in the first group and a second terminal row having the terminal elements in the second group; and applying a bending force in a direction perpendicular in a bending process to the plate face to the plate shaped molded article which is cut off in the cutting-off process so as to form a L-shaped bent section adapted to form a rear leg section on each of the terminal elements constituting the first terminal row and the second terminal row, thereby forming, on each terminal element, a horizontal straight section having an electric contact section to be electrically contacted with a counter terminal at a front end side thereof and a vertical straight section formed by being bent vertically downward from a rear end of the horizontal straight section, wherein in the bending process, by performing the bending while adjusting a position of the bent section of each terminal element in the vertical direction, heights of the rear leg sections of the terminal elements having different lengths from the lower end parts of the vertical straight sections to the bent sections are different in the order of the lengths of the terminal elements under a condition that the front end positions of the electric contact sections of all of the terminal elements in the respective first and second terminal rows are aligned.

4. A method for assembling a multi-stage connector having a terminal arrangement of 2N (where N=1, 2, 3, . . . ) stages in a vertical direction in which there is obtained the first terminal row and the second terminal row having the carriers according to the process of claim 3, the method comprising the steps of:

inserting horizontal straight sections of the terminal elements of the second terminal row into respective press-fit holes arranged from the lower end to the N-th stages at a rear wall of a connector housing of the multi-stage connector in a second terminal row assembling process, and thereby an electric contact section of each terminal element of the second terminal row is accommodated in a hood of the connector housing;

after performing the second terminal row assembling process, cutting-off the second carrier to which the rear leg sections of the terminal elements are connected in a second carrier cutting-off process;

after performing the second carrier cutting-off process, inserting horizontal straight sections of the terminal elements of the first terminal row into respective press-fit holes arranged from the top to the N-th stages at the rear wall of the connector housing of the multi-stage connector in a first terminal row assembling process, and thereby an electric contact section of each terminal element of the first terminal row is accommodated in the hood of the connector housing; and after performing the first terminal row assembling process, cutting-off the first carrier to which the rear leg sections of the terminal elements are connected in a first carrier cutting-off process.

* * * * *